US005897170A

United States Patent [19]

Keleny

[11] Patent Number: 5,897,170

[45] Date of Patent: Apr. 27, 1999

[54] SKATE WHEEL AND METHOD FOR MAKING

[75] Inventor: Lloyd Gerhardt Keleny, Champlin, Minn.

[73] Assignee: Rollerblade, Inc., Minneapolis, Minn.

[21] Appl. No.: 08/975,737

[22] Filed: Nov. 21, 1997

[51] Int. Cl.[6] ..... A63C 17/22

[52] U.S. Cl. ..... 301/5.3; 301/5.3; 301/5.7; 301/64.7; 280/11.22; 280/11.23; 152/393; 152/394; 152/323

[58] Field of Search ..... 301/5.3, 5.7, 64.7; 280/11.22, 11.23; 152/393, 394, 323

[56] References Cited

U.S. PATENT DOCUMENTS

| | | | |
|---|---|---|---|
| D. 330,883 | 11/1992 | Harr | D12/207 |
| D. 330,884 | 11/1992 | Harr | D12/209 |
| D. 339,320 | 9/1993 | Harr | D12/209 |
| 2,665,521 | 1/1954 | Ford | 301/5.3 |
| 2,697,010 | 12/1954 | Hirschmugl | 446/465 |
| 3,501,162 | 3/1970 | Toone | 301/5.3 |
| 4,447,093 | 5/1984 | Cunard et al. | 301/63 PW |
| 4,909,523 | 3/1990 | Olson | 280/11.22 |
| 5,026,106 | 6/1991 | Biermann | 295/1 |
| 5,308,152 | 5/1994 | Ho | 301/5.3 |
| 5,310,250 | 5/1994 | Gonsior | 301/5.3 |
| 5,478,140 | 12/1995 | Rocosky | 301/5.7 |
| 5,564,790 | 10/1996 | Lekavich | 301/5.3 |
| 5,630,891 | 5/1997 | Peterson et al. | 152/165 |
| 5,655,784 | 8/1997 | Lee | 280/11.22 |
| 5,660,447 | 8/1997 | Angelici | 301/5.7 |
| 5,692,809 | 12/1997 | Hook | 301/5.3 |
| 5,725,284 | 3/1998 | Boyer | 301/5.3 |

FOREIGN PATENT DOCUMENTS

| | | |
|---|---|---|
| 0 469 639 A2 | 2/1992 | European Pat. Off. . |
| 0 642814 A1 | 3/1995 | European Pat. Off. . |
| 2562804 | 10/1985 | France . |

OTHER PUBLICATIONS

"Straight Wheels", Speed Skating Times, J.L.H. Publications, Inc., Pompano Beach, Florida, 3 pages (Mar. 1996).

"Straight Wheels", 1 page Apr. 1996.

*Primary Examiner*—D. Glenn Dayoan
*Assistant Examiner*—Long Bao Nguyen
*Attorney, Agent, or Firm*—Merchant, Gould, Smith, Edell, Welter & Schmidt, P.A.

[57] ABSTRACT

The present invention relates generally to a hub for a skate wheel. The hub includes a central core member defining a bore for receiving an axle. A central axis of rotation passes through the center of the bore. The hub also includes first and second anchors extending radially outward from the core and disposed in axially spaced-apart relation such that an outwardly opening channel is defined between the first and second anchors. The first anchor includes a plurality of first radial projections separated by first spacing gaps. The second anchor includes a plurality of second radial projections separated by second spacing gaps. The first and second radial projections are staggered relative to each other about the central axis of rotation such that the first radial projections are aligned with the second spacing gaps and the second radial projections are aligned with the first spacing gaps.

17 Claims, 3 Drawing Sheets

SKATE WHEEL AND METHOD FOR MAKING

FIELD OF THE INVENTION

The present invention relates generally to wheels and methods for making such wheels. More particularly, the present invention relates to hub designs for skate wheels.

BACKGROUND OF THE INVENTION

Skating, particularly in-line skating, is becoming increasingly popular. In-line skates generally include wheels fastened in tandem to a skate boot. The wheels typically include a hub made of rigid plastic material. A tire made of synthetic plastic material is typically molded about the periphery of the hub. Examples of in-line skates and hubs are shown in U.S. Design Pat. Nos. Des. 339,320; Des. 330,884; and Des. 330,883.

As shown in the above-referenced prior art patents, prior art skate hubs typically have a generally cylindrical core. Extending radially outward from the midpoint of the core is a protrusion. A plurality of holes are formed through the protrusion with the holes being circumferentially spaced about the axis of the core. A tire, typically made of urethane, is molded around the periphery of the hub. During the molding process, urethane flows into the holes formed through the protrusion. As a result of the molding process, the urethane material of the tire is securely molded to the hub.

EP Publication No. 0 642 814 A1 discloses a wheel including a central hub having a plurality of spokes. The wheel also includes a tire which may partially or fully affect the interspace between the spokes and the central hub. The wheel is configured to allow a user to preset the optimum degree of rigidity according to his/her individual technical requirements and according to the type of surface on which the wheel is to be used.

U.S. Pat. No. 5,310,250 discloses a skate wheel including a hub having a core and a central rail positioned at a mid-region of the core. The central rail is connected to the core by a plurality of staggered inner support members. A tire is mounted on the core and formed over the central rail.

At times, a wheel may experience substantial side forces on the hub and tire. The side forces can cause the molded urethane tire to break away from the hub (referred to as de-lamination). Furthermore, as the tire wears, the diameter of the wheel decreases. Therefore, the distance between the outer periphery of the tire and outer periphery of the central protrusion of the hub progressively decreases during wear of the tire. As this distance gradually decreases, the performance or bounce of the wheel also decreases.

Certain improvements to skate wheels have been developed to overcome the above-identified problems. For example, in some skate wheels, the central protrusion of the hub core has been replaced with a pair of anchors or rings that extend around the circumference of the hub core. The anchors are provided in spaced-apart relation to define a material receiving volume therebetween. A urethane tire is molded over the pair of anchors and at least partially fills the material-receiving volume formed between the anchors.

The above-identified hub configuration is typically manufactured via an injection molding process. Generally, a four-piece mold is used to define an inner volume that coincides with the shape of the hub. To form the hub, plastic material is injected into the inner volume defined by the mold. After the plastic material has cooled and hardened, the formed hub can be removed from the mold.

SUMMARY OF THE INVENTION

One aspect of the present invention relates to a hub for a skate wheel. The hub includes a central core member defining a bore for receiving an axle. A central axis of rotation of the hub extends through the center of the bore. First and second anchors extend radially outward from the core and are disposed in axially spaced-apart relation such that an outwardly opening central channel is defined between the first and second anchors. The first anchor includes a plurality of first radial projections separated by first spacing gaps. The second anchor includes a plurality of second radial projections separated by second spacing gaps. The first and second radial projections are staggered relative to each other about the central axis of rotation of the hub such that the first radial projections are aligned with the second spacing gaps, and the second radial projections are aligned with the first spacing gaps.

Another aspect of the present invention relates to a skate wheel incorporating the above-described hub. The wheel includes a urethane tire molded about the circumference of the core member of the hub.

The aforementioned hub is advantageous over the prior art because it can be manufactured by an injection molding process that utilizes a mold solely comprising first and second mating pieces. By contrast, prior art techniques for manufacturing hubs having spaced-apart radial anchors typically require molds having at least four pieces. As compared to a four-part mold, a two-part mold is less expensive to tool and easier to maintain and utilize in a forming process. Consequently, the present invention provides a hub that can be manufactured in an efficient and cost-effective manner.

An exemplary method for manufacturing a hub in accordance with the principles of the present invention includes the step of providing a mold solely comprising first and second mating pieces. The method also includes the step of interconnecting the first and second mating pieces such that the pieces define an interior volume that coincides the shape of the hub. The interior volume of the mold includes portions corresponding to the hub core and portions corresponding to the first and second anchors of the hub. The method further includes the step of injecting plastic material into the interior volume defined by the first and second mating pieces. Once the plastic material within the mold has cooled and hardened, the first and second mating pieces of the mold are disconnected to remove the mold from the formed hub.

A variety of additional advantages of the invention will be set forth in part in the description which follows, and in part will be obvious from the description, or maybe learned by practicing the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated and constituted a part of this specification, illustrate various aspects of the present invention and together with the description, serve to explain the principles of the invention. A brief description of the drawings is as follows.

DETAILED DESCRIPTION OF THE INVENTION

Reference will now be made in detail to exemplary aspects of the present invention which are illustrated in the accompanying drawings. Wherever possible, the same reference numbers will be used throughout the drawings to refer to the same or like parts.

Figure 1:
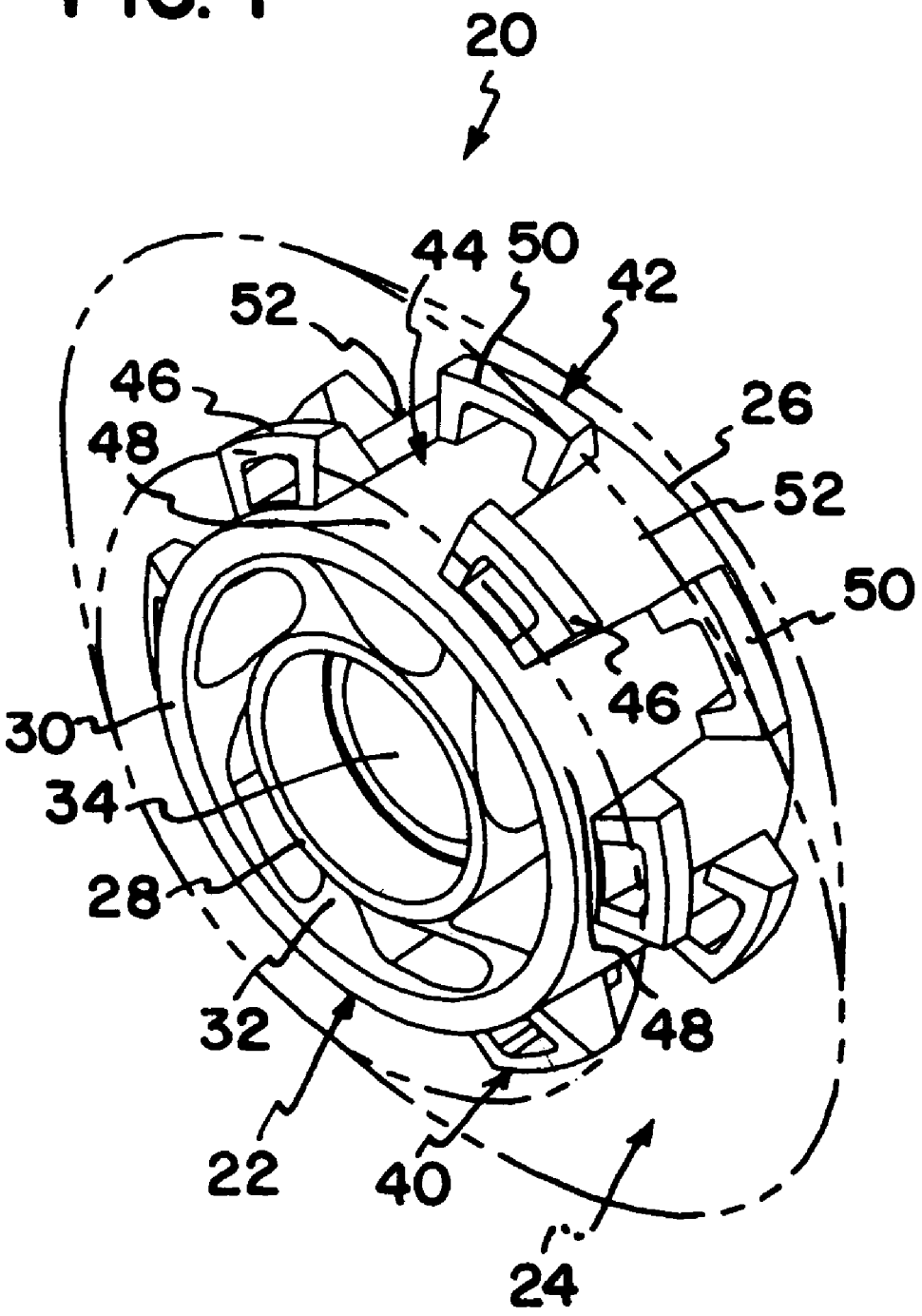
FIG. 1 is a perspective view of a wheel constructed in accordance with the principles of the present invention.
Figure 2:
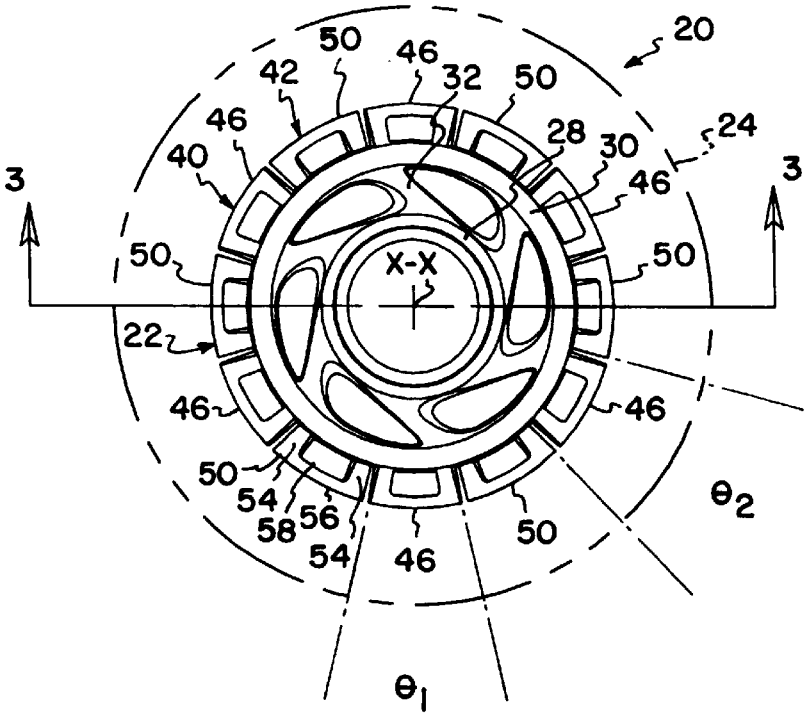
FIG. 2 is a front elevational view of the wheel of FIG. 1.
Figure 3:
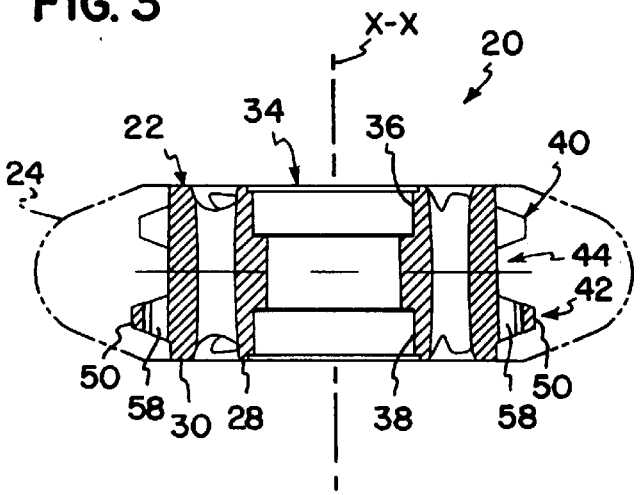
FIG. 3 is a cross-sectional view taken along Section Line 3—3 of FIG. 2.

FIGS. 1–3 illustrate a wheel 20 constructed in accordance with the principles of the present invention. The wheel 20 includes a stiff, synthetic plastic hub 22 on which is mounted a molded urethane tire 24. For ease of illustration, in the various figures, the tire 24 is shown in phantom lines so that the various features of the hub 22 may be clearly identified.

The hub 22 includes a central core 26 including an inner cylinder 28 and an outer cylinder 30. The inner and outer cylinders 28, 30 of the core 26 are interconnected by spokes 32 that are substantially tangentially aligned with respect to the inner cylinder 28. The inner cylinder 28 defines a bore 34 for passing an axle or similar structure suitable for connecting the hub 22 to a skate. A central axis x—x of rotation extends through the center of the bore 34. The inner cylinder 28 also defines outwardly opening pockets 36, 38 configured to receive bearings or the like (not shown). Typically, the bearings would be press-fit into the pockets 36, 38 and would facilitate rotatably mounting the hub 22 on an axle.

The hub 22 also includes first and second anchors 40, 42 that project radially outward from the outer cylinder 30 of the core 26. The anchors 40, 42 extend circumferentially about the core 26 and are provided in axially spaced-apart relation to define a centrally located material-receiving volume 44 therebetween. The material receiving volume 44 comprises an outwardly opening central channel which extends about the circumference of the core.

The first anchor 40 includes a plurality of first radial projections 46 separated by first spacing gaps 48. The first radial projections 46 are uniformly spaced about the circumference of the outer cylinder 30 and are in generally planar alignment with one another. The second anchor 42 includes second radial projections 50 separated by second spacing gaps 52. Similar to the first radial projections 46, the second radial projections 50 are uniformly spaced around the circumference of the outer cylinder 30 and are in generally planar alignment with one another.

To facilitate molding the hub 22, the first and second radial projections 46, 50 are staggered relative to each other about the central axis x—x. The first and second radial projections 46, 50 are preferably staggered relative to one another such that the first radial projections 46 align with the second spacing gaps 52 and the second radial projections 50 align with the first spacing gaps 48. Additionally, the first and second projections 46, 50 are preferably subtended by first angles $\theta_1$, while the first and second spacing gaps 48, 52 are preferably subtended by second angles $\theta_2$ that are equal to or greater than the first angles $\theta_1$.

Each of the projections 46, 50 that form the anchors 40, 42 are individually distinct and separate from one another. Additionally, each radial projection 46, 50 includes a pair of spaced-apart radial legs 54 interconnected by an arc leg 56 that bridges the radial legs 54. Furthermore, each radial projection 46, 50 has a generally rectangular shape and defines a substantially rectangular opening 58 extending therethrough.

The tire 24 of the wheel 20 is mounted on the outer cylinder 30 of the hub 22. It is preferred for the tire 24 to at least partially fill the material-receiving volume 44 and to completely cover the anchors 40, 42. Additionally, portions of the tire 24 preferably extend through the rectangular openings 58 of the radial projections 46, 50 such that the tire 24 is securely retained on the hub 22. Also, portions of the tire 24 fill the spacing gaps 48, 52 located between the radial projections 46, 50.

The staggered configuration of the radial projections 46, 50 is advantageous because it allows the hub 22 to be manufactured by an injection molding technique that utilizes a mold solely comprising first and second mating pieces. By reducing the complexity of the molding process, fabrication costs of the hub are reduced.

Figure 4:
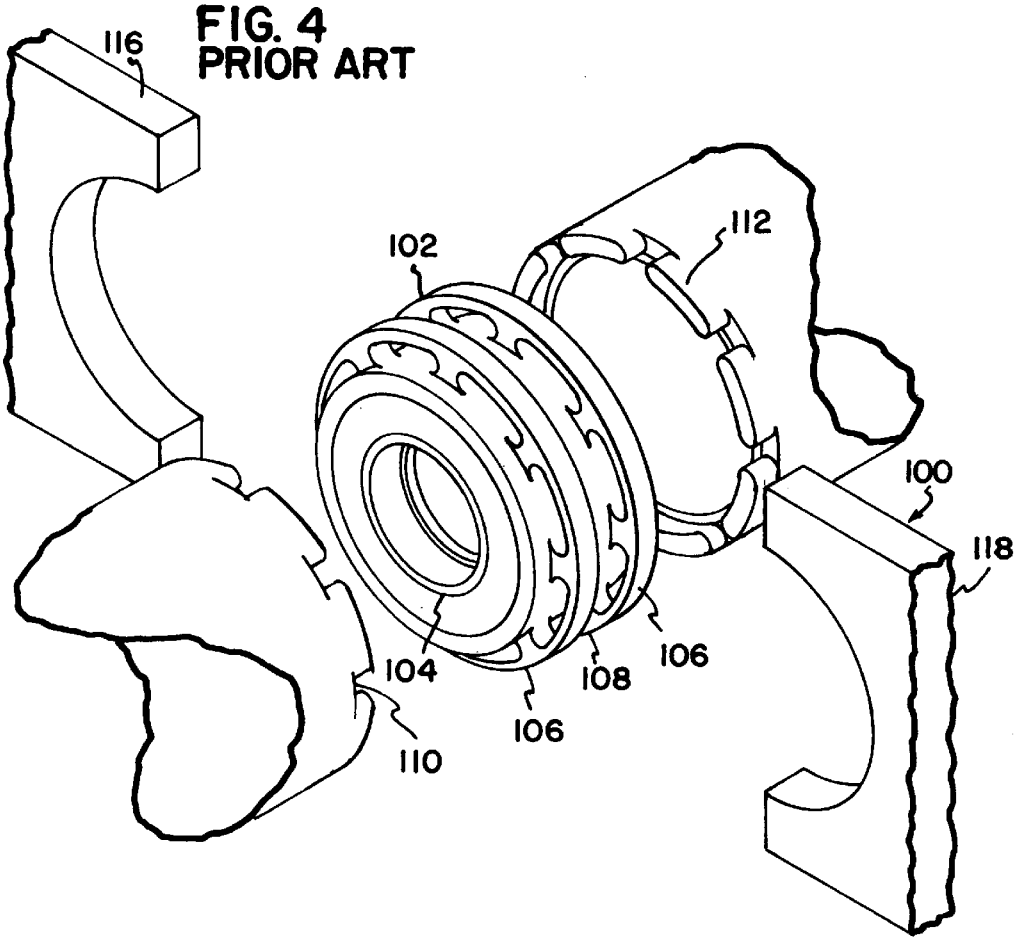
FIG. 4 PRIOR ART
FIG. 4 is a schematic illustration showing an exemplary molding technique for manufacturing a prior art hub.

FIG. 4 schematically shows a mold 100 for injection molding a prior art hub 102. The hub 102 includes a core 104 and apair of anchors 106 that project radially outward from the core 104. The anchors 106 extend continuously around the circumference of the core 104. Additionally, the anchors 106 are arranged in spaced-apart relation such that a material-receiving volume 108 is defined between the anchors 106.

The mold 100 includes first and second pieces 110, 112 that cooperate to form the core 104, the anchors 106, and apertures 114 within the anchors 106. The mold 100 also includes third and fourth pieces 116, 118 that cooperate to form the material-receiving volume 108 located between the anchors 106. The third and fourth pieces 116, 118 are required to form the material-receiving volume 108 because the anchors 106 prevent the first and second pieces 110, 112 from axially accessing the material-receiving volume 108. Consequently, the third and fourth pieces 116, 118 access the material-receiving volume from a radial rather than an axial direction.

Figure 5:
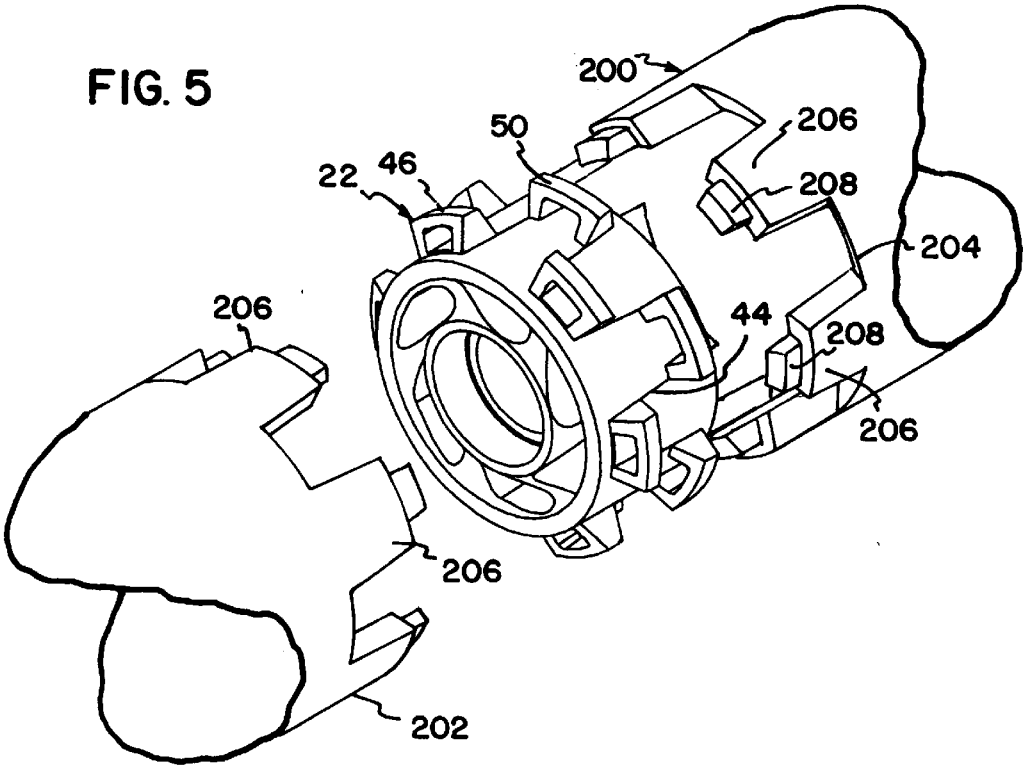
FIG. 5 is a schematic illustration showing a method in accordance with the principles of the present invention for manufacturing the hub of FIGS. 1–3.

FIG. 5 shows a mold 200 constructed in accordance with the principles of the present invention for molding the hub 22. The mold 200 includes first and second mating pieces 202, 204. The pieces 202, 204 include interlocking fingers 206 that cooperate to form the radial projections 46, 50 and material-receiving volume 44 of the hub 22. Additionally, the fingers 206 include tabs 208 for forming the rectangular openings 58 in the radial projections 46, 50.

The staggered configuration of the radial projections 46, 50 allows all of the void areas of the hub 22 to be accessed from an axial direction. For example, unlike the anchors 106 of the prior art hub 102, the radial projections 46, 50 do not prevent the first and second mating pieces 202, 204 from interconnecting and filling the volume that corresponds to the material-receiving volume 44 of the hub 22.

To manufacture the hub, the first and second mating pieces 202, 204 are interconnected such that the pieces 202, 204 define an interior volume that coincides with the shape of the hub 22. The interior volume of the mold 200 includes void regions that correspond with the core 26 of the hub 22 and the first and second radial projections 46, 50 of the hub 22. Once the first and second pieces 202, 204 are interconnected, a plastic material is injected into the interior volume defined by the mold 200. The plastic material is then allowed to cool such that the plastic material hardens within the mold 200. After the plastic material has hardened, the first and second mating pieces 202, 204 are disconnected and the formed hub 22 is removed from the mold 200. After the hub 22 has been removed form the mold 200, the hub 22 is then subjected to another injection molding process in which the tire 24 is injection-molded about the hub 22 to form the wheel 20. As the tire 24 is injected around the hub 22, the material forming the tire 24 at least partially fills the material-receiving volume 44 of the core 26 and also flows through the rectangular openings 58 of the radial projections 46, 50. Consequently, once the urethane material forming the tire 24 hardens, the tire 24 is securely connected to the hub 22.

With regard to the foregoing description, it is to be understood that changes may be made in detail, especially in matters of the construction material employed and the shape, size and arrangement of the parts without departing from the scope of the present invention. It is intended that the specification and the depicted aspects of the invention may be considered exemplary only, with a true scope and spirit of the invention being indicated by the broad meaning of the following claims.

What is claimed is:

1. A hub for a skate wheel comprising:

a core having a central axis of rotation; and first and second anchors projecting radially outward from the core and extending circumferentially about the core, the first and second anchors being disposed in axially spaced-apart relation such that an outwardly opening central channel is defined between the first and second anchors, the first anchor including a plurality of first radial projections separated by first spacing gaps, the second anchor including a plurality of second radial projections separated by second spacing gaps, and the first and second radial projections being staggered relative to each other about the central axis of rotation such that the first radial projections are aligned with the second spacing gaps and the second radial projections are aligned with the first spacing gaps.

2. The hub of claim 1, wherein the first and second projections are spaced uniformly about a periphery of the core.

3. The hub of claim 1, wherein the projections are substantially rectangular.

4. The hub of claim 3, wherein the projections define substantially rectangular openings formed through the projections.

5. The hub of claim 1, wherein the first projections are subtended by first angles, and the second spacing gaps are subtended by second angles that are equal to or greater than the first angles.

6. The hub of claim 1, wherein the first and second projections are subtended by first angles, and the first and second spacing gaps are subtended by second angles that are equal to or greater than the first angles.

7. A wheel comprising:

a core having a central axis of rotation;

first and second anchors projecting radially outward from the core and disposed in axially spaced apart relation such that an outwardly opening central channel is defined about the circumference of the core between the first and second anchors, the first anchor including a plurality of first radial projections separated by first spacing gaps, the second anchor including a plurality of second radial projections separated by second spacing gaps, the first and second radial projections being staggered relative to each other about the central axis of rotation such that the first radial projections are aligned with the second spacing gaps and the second radial projections are aligned with the first spacing gaps; and a tire mounted on the core and surrounding the first and second anchors, the tire at least partially filling the outwardly opening channel.

8. The wheel of claim 7, wherein the tire is made of a plastic material.

9. The wheel of claim 8, wherein the first and second projections define openings that extend through the projections, and the plastic material is molded within the openings.

10. The hub of claim 7, wherein the first and second projections are spaced uniformly about a periphery of the core.

11. The hub of claim 7, wherein the projections are substantially rectangular.

12. The hub of claim 11, wherein the projections define substantially rectangular openings formed through the projections.

13. The hub of claim 7, wherein the first projections are subtended by first angles, and the second spacing gaps are subtended by second angles that are equal to or greater than the first angles.

14. The hub of claim 7, wherein the first and second projections are subtended by first angles, and the first and second spacing gaps are subtended by second angles that are equal to or greater than the first angles.

15. A method for making a hub for a skate wheel, the hub including a central core member defining a bore for receiving an axle and including a central axis of rotation, and first and second anchors extending radially outward from the core and disposed in axially spaced apart relation such that an outwardly opening central channel is defined between the first and second anchors, the method comprising the steps of:

providing a mold solely comprising first and second mating pieces;

interconnecting the first and second mating pieces such that the pieces define an interior volume that coincides with the shape of the hub, the interior volume including portions corresponding to the core and the first and second anchors of the hub;

injecting plastic material into the interior volume defined by the first and second mating pieces such that the plastic material forms the core the and the first and second anchors, the first and second anchors being arranged to define the outwardly opening central channel therebetween;

cooling the plastic material such that the plastic material hardens to form the hub within the mold; and disconnecting the first and second mating pieces and removing the mold from the hub.

16. The method of claim 15, wherein the first anchor includes a plurality of first radial projections separated by first spacing gaps, the second anchor includes a plurality of second radial projections separated by second spacing gaps, and the first and second radial projections are staggered relative to each other about the central axis of rotation such that the first radial projections are aligned with the second spacing gaps and the second radial projections are aligned with the first spacing gaps, and wherein the first and second mating pieces have interlocking fingers that cooperate to form the staggered first and second radial projections.

17. The method of claim 16, wherein the first and second radial projections have apertures extending therethrough, and the interlocking fingers include tabs configured for forming the apertures.

* * * * *